US005934058A

United States Patent [19]

Hirao et al.

[11] Patent Number: 5,934,058

[45] Date of Patent: Aug. 10, 1999

[54] PIECING METHOD AND APPARATUS FOR A SPINNING MACHINE

[75] Inventors: Osamu Hirao; Masahiko Nishimura, both of Uji, Japan

[73] Assignee: Murata Kikai Kabushiki Kaisha, Kyoto, Japan

[21] Appl. No.: 08/987,472

[22] Filed: Dec. 9, 1997

[30] Foreign Application Priority Data

Jan. 13, 1997 [JP] Japan ..... 9-015884

[51] Int. Cl.[6] ..... D01H 5/00; D01H 7/46

[52] U.S. Cl. ..... 57/261; 57/280; 57/328; 57/333

[58] Field of Search ..... 57/261, 279, 280, 57/328, 333, 350

[56] References Cited

U.S. PATENT DOCUMENTS

| | | | |
|---|---|---|---|
| 4,550,560 | 11/1985 | Tanaka et al. | 57/261 |
| 4,620,413 | 11/1986 | Anahara et al. | 57/261 |
| 4,845,936 | 7/1989 | Artzt et al. | 57/261 |
| 4,893,461 | 1/1990 | Artzt et al. | 57/261 |
| 5,511,373 | 4/1996 | Banba | 57/328 |
| 5,673,547 | 10/1997 | Baba et al. | 57/261 |
| 5,704,204 | 1/1998 | Mima et al. | 57/280 |

FOREIGN PATENT DOCUMENTS

| | | |
|---|---|---|
| 448518 | 9/1991 | France . |
| 6173132 | 6/1994 | Japan . |
| 6220729 | 8/1994 | Japan . |

*Primary Examiner*—William Stryjewski
*Assistant Examiner*—Tejash D Patel
*Attorney, Agent, or Firm*—Armstrong, Westerman, Hattori, McLeland & Naughton

[57] ABSTRACT

A method and apparatus are described for piercing severed yarn to a sliver in a spinning machine in a manner to prevent formation of an excessively long or frail piecing portion by passing leading yarn Y' through a twist device T; driving draft rollers 1, 2, which have been stopped following severance of the yarn to remove the thinned, tapered tip of sliver 6 from the front roller 4; and then introducing sliver for piecing into the twist device while removing a portion of the fibers constituting such a sliver to make the piecing portion thereof more nearly as thick as the leading yarn.

5 Claims, 5 Drawing Sheets

PIECING METHOD AND APPARATUS FOR A SPINNING MACHINE

FIELD OF THE INVENTION

The present invention relates to a piecing method and apparatus for joining cut yarn for a spinning machine.

BACKGROUND OF THE INVENTION

Known piecing methods and apparatuses draw a leading yarn out from a sliver guide entrance of a nozzle constituting a twist device before driving a draft device to resume supplying a sliver while operating the twist device to entangle fibers constituting the sliver with the leading yarn for piecing.

In the conventional piecing method and apparatus, when the yarn is cut, the tip of a sliver torn between a stopped draft roller and an operating draft roller is thinned and tapered. When spinning is resumed, the cut end of the thinned and tapered sliver is drafted further, thereby increasing the length of the tapered portion. If the tapered portion is long, the piecing portion will be long and thin, which is not preferable. On the other hand, if the tapered sliver is removed and a new sliver of a normal fiber density is supplied, an excessively thick piecing portion will be formed when this sliver is entangled with the leading yarn.

In addition, in the conventional piecing method and apparatus, the leading yarn drawn out from the sliver guide entrance may be curled or folded by the twisting torque of the yarn or as a result of its contact with the nozzle. Under this condition, when fibers constituting a sliver are entangled with the leading yarn for piecing, a piecing portion will have an unstable form.

It is an object of this invention to provide a piecing method and apparatus for a spinning machine that solves the problems of said conventional piecing method and apparatus, and that can provide a piecing portion of an appropriate strength and form.

SUMMARY OF THE INVENTION

To achieve this object according to, this invention leading yarn is passed through a twist device, then draft rollers which have been stopped, are driven in order to remove the tip of the severed end of the sliver supplied from the front roller, and then an uncut sliver is passed through the twist device while removing a portion of the fibers constituting the sliver.

DETAILED DESCRIPTION OF THE PREFERRED EMBODIMENTS

Hereafter, an embodiment of this invention will be described using FIGS. 1 to 5, but the present invention is not limited to that described, provided that the essence of the invention is not utilized.

Figure 1:
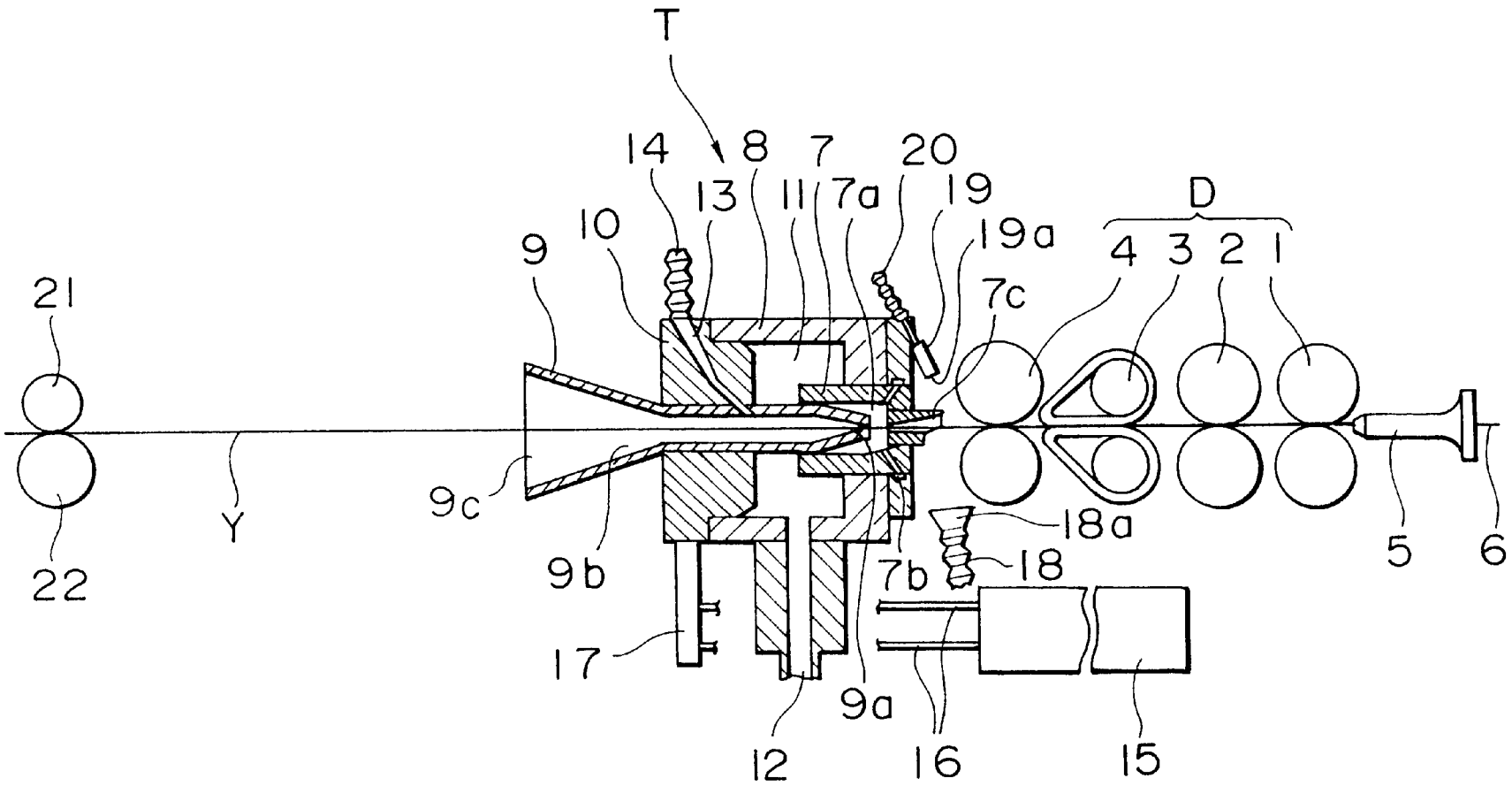
FIG. 1 is a side view of a spinning machine to which the present invention is applied, including a partial cross section.

First, a spinning machine to which the piecing method and apparatus for a spinning machine according to this invention is applicable is described with reference to FIG. 1.

D is a draft device and a four-line draft device D is shown as an example. The draft device D is composed of a back roller 1, a third roller 2, a middle roller 3 on which an apron belt is installed, and a front roller 4. Numeral 5 is a sliver guide and the sliver 6 inserted into the sliver guide 5 and supplied to the draft device D is drawn and then supplied to a twist device, described below, in which a yarn Y is produced.

A twist device T is mainly composed of a nozzle 7 that jets compressed air to generate a rotating air flow, a nozzle block 8 that supports the nozzle 7, a spindle (yarn guide tube) 9 having an insertion hole 9*b* and a tip 9*a* which is located inside space 7*a* the nozzle 7, and a spindle supporting member 10 that supports the spindle 9. A plurality of air injection holes 7*b* for generating a rotating air flow are formed in the nozzle 7. Numeral 11 indicates an air chamber formed between the nozzle block 8 and the spindle supporting member 10, and is coupled to an air suction source (not shown in the drawing) that sucks air at a low suction pressure via a suction hole 12 in order to act as a hole through which air jetted from the air injection holes 7*b* of the nozzle 7 escapes during spinning while sucking and removing fly fibers generated within the air chamber 11.

Numeral 13 is an air blowing hole formed through the spindle 9 and the spindle supporting member 10 for generating an air flow flowing toward the tip 9*a* of the spindle 9. The air blowing hole 13 is connected to a source of compressed air (not shown in the drawing) via a pipe 14 coupled to the spindle supporting member 10.

Numeral is a cylinder wherein a lower frame 17 of the spindle supporting member 10 is attached to the tip of a piston rod 16 of the cylinder. Thus, the cylinder 15 can be operated to move the spindle supporting member 10 rightward and leftward in order to remove or couple the spindle supporting member 10 to or from the nozzle block 8.

Numeral 18 is a suction tube, and a suction port 18*a* of which is disposed between a sliver guide entrance 7*c* of the nozzle 7 and the front roller 4, and below the sliver guide entrance 7*c,* and which is connected to the air suction source (not shown in the drawing). Numeral 19 is an air blowing tube and its air exit port 19*a* is directed toward the sliver guide entrance 7*c* of the nozzle 7 and disposed opposite to the suction tube 18 in such a way that the sliver guide entrance 7*c* is located between the air blowing tube 19 and the suction tube 18, and the air blowing tube 19 is connected to the source of compressed air (not shown in the drawing) via a pipe 20. Numeral 21 is a nip roller that can contact and leave a delivery roller 22 that is constantly rotated so that the nip roller 21 comes into contact with the delivery roller 22 to transfer spun yarn Y in the direction of a winding device (not shown in the drawing).

In an operational state in which the spinning machine produces the yarn Y, the sliver 6, supplied to the draft device D from the sliver guide 5, is drawn by the draft device D and then twisted by the twist device T to produce the yarn Y. That is, fibers constituting the sliver 6 supplied to the nozzle 7 of the twist device T enter the insertion hole 9*b* of the spindle 9 from the tip 9*a* while being rotated by the rotating air flow jetted from the air injection holes 7*b* and are thus formed into the yarn Y. In such a normal operational state of the spinning machine, the supply of compressed air from the air blowing hole 13 is stopped and no compressed air is supplied to the air blowing tube 19. Suction air is always provided through the suction hole 12 and suction tube 18.

Figure 2:
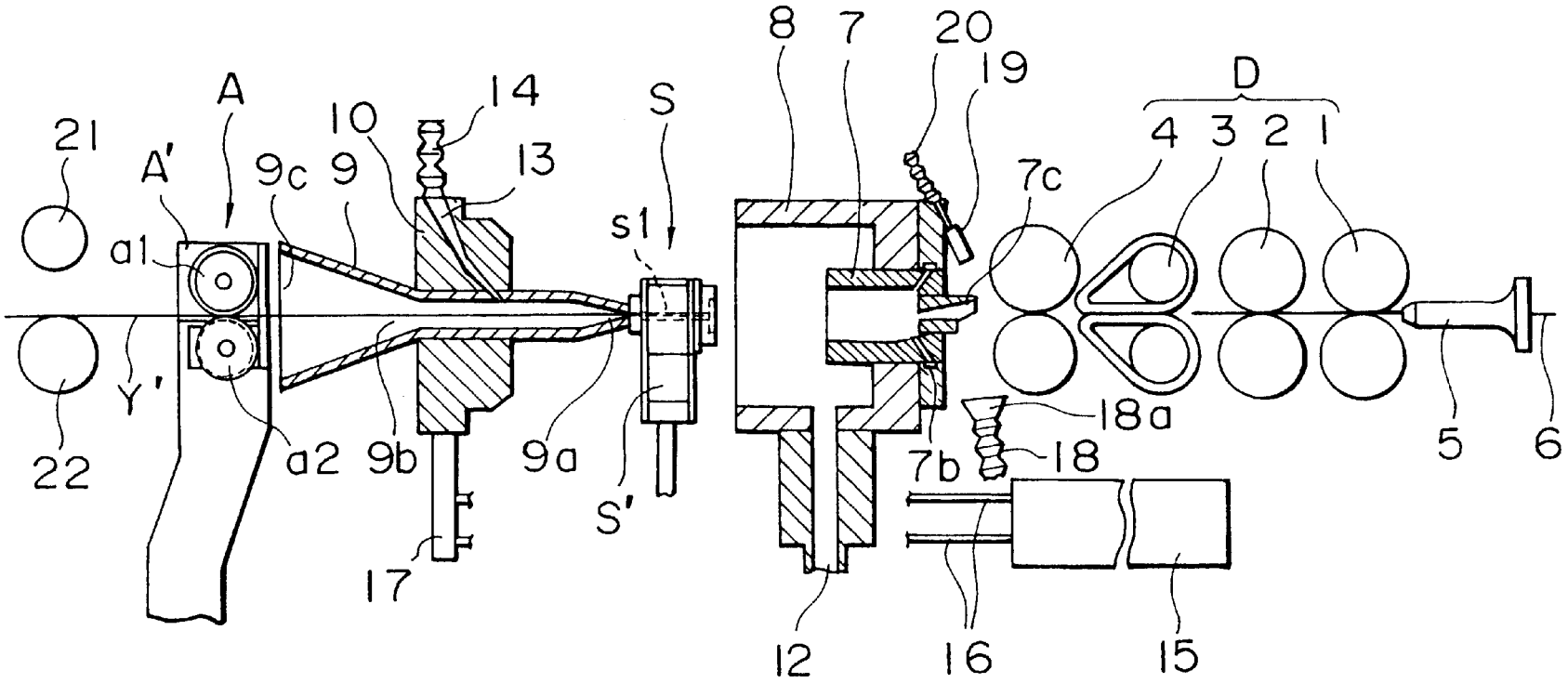
FIG. 2 is another side view of the spinning machine to which the present invention is applied, including a partial cross section, showing the machine in another stage of operation.

Next, a piecing process is described with reference to FIGS. 2 and 3.

If the yarn is cut, a detection sensor (not shown in the drawings) issues a detection signal, and the operation of the back and third rollers 1 and 2 is stopped via a clutch (not shown in the drawings) connected to the back roller 1 to halt the supply of the sliver 6. The twist device T continues to operate. The sliver 6 is torn between the third roller 2 that has been stopped and the middle roller 3 that continues rotating so that its tip is tapered. In addition, after a specified period of time, the jetting of air from the air injection holes 7*b* is stopped to halt the operation of the twist device T. After the operation of the twist device T has been stopped to finish the production of the yarn Y, the nip roller 21 is detached from the delivery roller 22.

The cylinder 15 is then operated so as to cause the piston rod 16 to advance, thereby detaching the spindle supporting member 10 from the nozzle block 8. In addition, a head A' of a transfer arm member A, which uses a pair of drive rollers a1, a2 to grip the tip of leading yarn Y' wound in a winding package and drawn out therefrom using a well known suction gripping device or drawn out from a separately prepared package, Is disposed in proximity to a yarn exit port 9*c* of the spindle 9.

On the other hand, a suction head S' of an air sucker member S is disposed between the detached spindle supporting member 10 and the nozzle block 8 in such a way as to place the tip 9*a* of the spindle 9 in close proximity to a suction hole s1 of the suction head S' or to place the tip 9*a* in contact with the suction hole s1. The suction head S' is subsequently operated to provide the insertion hole 9*b* of the spindle 9 with a suction-air flow flowing toward the tip 9*a* from the yarn exit port 9*c* while the drive rollers a1, a2 of the transfer arm member A are operated to pass the leading yarn Y' through the insertion hole 9*b* of the spindle 9, as shown in FIG. 2.

Figure 3:
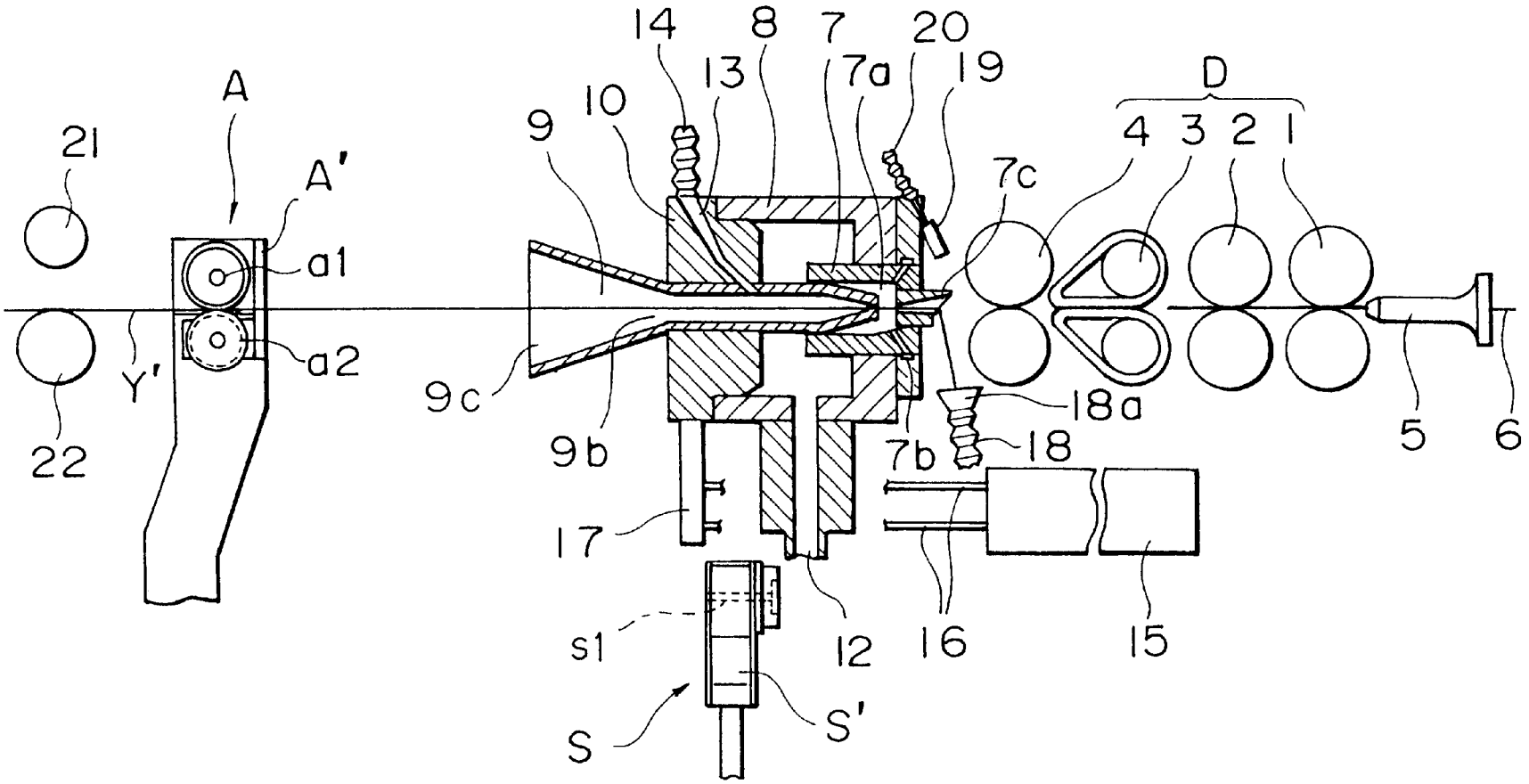
FIG. 3 is a side view of the spinning machine to which the present invention is applied, including a partial cross section, showing the machine in yet another stage of operation.

The air suction member S is then lowered and the cylinder 15 is then operated to move the piston rod 16 backward in order to couple the spindle supporting member 10 to the nozzle block 8, as shown in FIG. 3.

Then, compressed air is supplied to the air blowing hole 13 from the source of compressed air (not shown in the drawings) via the pipe 14 to provide through the insertion hole 9*b* of the spindle 9 an air flow flowing toward the tip 9*a*. This air compressed causes the leading yarn Y' passed through the insertion hole 9*b* of the spindle 9 to be ejected from the sliver guide entrance 7*c* of the nozzle 7 and to be inserted into the suction tube 18 through which a suction air flow is provided. After the leading yarn Y' has passed through the insertion hole 9*b* of the spindle 9 and the nozzle 7, that is, through the twist device T, the transfer arm member A is returned to a specified standby position.

Although the air flow flowing from the air blowing hole 13 toward the tip 9*a* of the spindle 9 can be continuously provided until the leading yarn Y' has been passed through the insertion hole 9*b* of the spindle 9 and the nozzle 7, since the leading yarn Y' may be cut due to its thickness or the length of the fibers constituting it, the air flow should be passed intermittently for several times toward the tip 9*a* of the spindle 9. When the leading yarn Y' is passed through the insertion hole 9*b* of the spindle 9 and the nozzle 7, and if a required length of leading yarn Y' has already been fed, the drive rollers a1, a2 of the transfer arm member A may be stopped in order to prevent excessive yarn Y' from being fed or may be operated to feed the yarn Y' sequentially.

When air is jetted through the air blowing tube 19 toward the sliver guide entrance 7*c* of the nozzle 7 before or after passing the leading yarn Y' through the insertion hole 9*b* of the spindle 9 and the nozzle 7, that is, through the twist device T, the leading yarn Y', which has been ejected from the sliver guide entrance 7*c* of the nozzle 7, is sucked into and retained in the suction tube 18 in order to prevent it from being drawn, curled, or folded. Thus, a piecing portion formed by piecing the leading yarn Y' drawn in this manner has the proper thickness and has a stable form.

While the operation of the twist device T is stopped, that is, the jetting of air from the air injection holes 7*b* is stopped, the back and third rollers 1 and 2, which have been stopped, are then restarted to transfer the sliver 6 gripped by the back and third rollers 1 and 2. At approximately the same time, compressed air is again jetted from the air blowing hole 13 for a specified period of time in order to prevent the sliver 6 from being introduced into the sliver guide entrance 7*c* of the nozzle 7. The sliver 6, which is prevented from being introduced into the sliver guide entrance 7*c* of the nozzle 7, is sucked into the suction tube 18.

Figure 4:
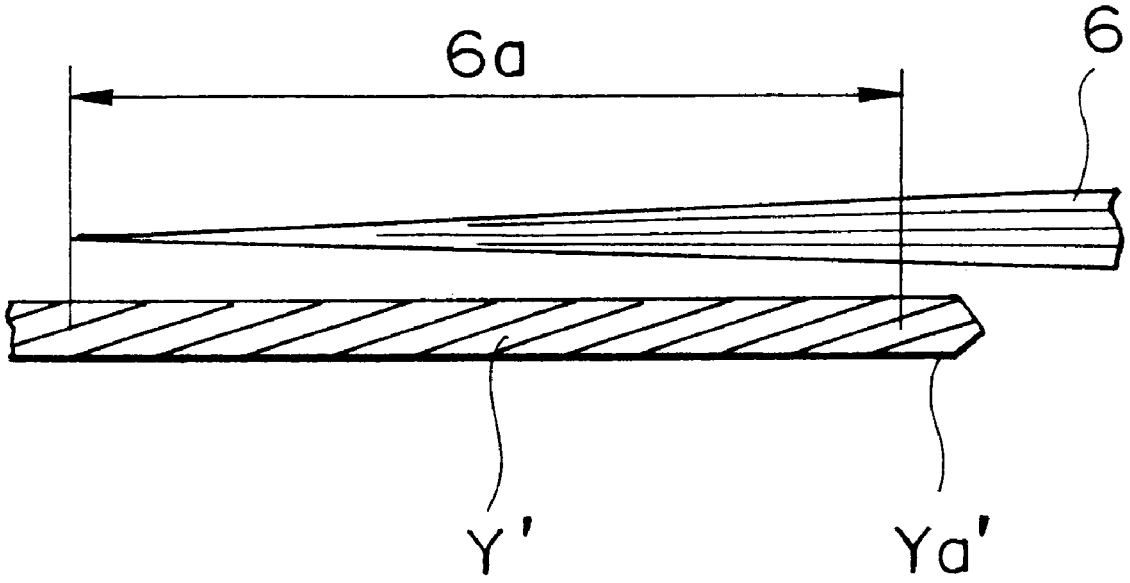
FIG. 4 is a schematic drawing showing the tip of a sliver and the tip of leading yarn, which constitute a conventional piecing portion.

When the yarn is cut, the sliver 6 torn between the third roller 2 that has been stopped and the middle roller 3 that continues operation has its tip thinned and tapered. The cut end of the sliver 6 that is thinned and tapered is further drafted by the middle and front rollers 3 and 4, thereby increasing the length of a tapered portion 6*a* as shown in FIG. 4. If the tapered portion 6*a* is long, the piecing portion will be long, which is not preferable, and the leading yarn Y' will even be longer. In addition, if the tip Ya' of the leading yarn Y' is located in the middle of the tapered portion 6*a* during piecing, a thin and weak piecing portion will be formed, thereby creating a tendency for the yarn to be cut at this portion. To prevent this problem, compressed air is jetted from the air blowing hole 13 for a specified period of time to prevent the long thin tapered sliver 6 from being introduced into the nozzle 7.

As described above, after the thin tapered sliver 6 has been removed, and displaced into the suction tube 18 the jetting of compressed air through the air blowing hole 13 is stopped while the nip roller 21 is placed in contact with the delivery roller 22 that is constantly rotated in order to transfer the leading yarn Y' in the direction of the winding device. In addition, immediately after the nip roller 21 has been placed in contact with the delivery roller 22, the twist device T is reactivated, that is, air is jetted from the air injection holes 7*b*. A suction air flow stronger than that in the suction tube 18 is then provided via the suction hole 12 near the sliver guide entrance 7*c* of the nozzle 7 and silver is discharged from the front roller 4, so fibers constituting the sliver 6 with the tapered portion 6*a* of a reduced length are introduced into the sliver guide entrance 7*c* of the nozzle 7 and the fibers are entangled with the leading yarn Y' drawn out from the suction tube 18 for piecing.

In addition, the supply of air jetted through the air blowing tube 19 can be continued during piecing, that is, even after the tapered portion at the tip of the sliver 6 has been removed, the jetted air continues to be supplied in order to remove a portion of fibers constituting the sliver 6 supplied from the front roller 4 to the suction tube 18, and the amount of fibers entangled with the leading yarn Y' is adjusted to make a piecing portion more nearly as thick as the leading yarn Y'. Once the piecing operation has been completed, the jetting of air from the air exit port 19*a* of the air blowing tube 19 is stopped.

Figure 5:
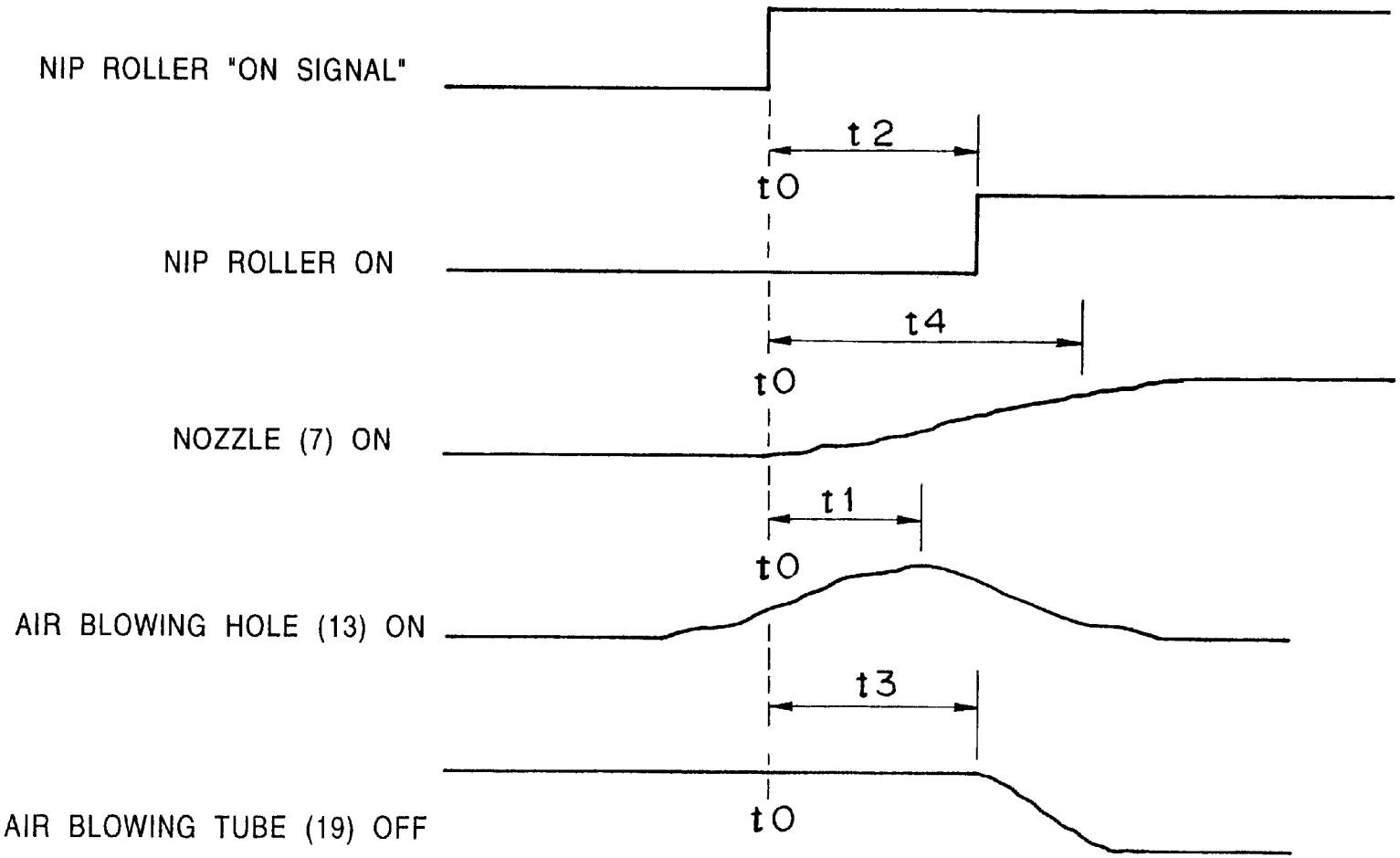
FIG. 5 is a timing chart for the main piecing process.

FIG. 5 shows a timing chart of the piecing operation.

In FIG. 5, the jetting of air from the nozzle 7 of the twist device T is begun that approximately the same time at an ON signal is issued at time t0, causing the nip roller 21 to come into contact with the delivery roller 22. Once time t1 has elapsed, the air blowing hole 13 is deactivated (OFF), and once time t2 has elapsed, the nip roller 21 comes into contact with the delivery roller 22. When the nip roller 21 is activated, the leading yarn Y' starts running and the sliver 6 is supplied to the twist device T and entangled with the leading yarn Y' for piecing. Since, air is still being jetted from the air blowing tube 19, however, part of the fibers forming sliver 6 are sucked into the suction tube 18 and removed. The air blowing tube 19 is deactivated (OFF) after time t3 has elapsed. Once time t4 has elapsed, the nozzle 7 provides a set air pressure. Times t1 to t4 are set so that t1<t2<t3<t4. The chart for the nozzles 7, air blowing hole 13, air blowing tube 19 in FIG. 5 shows the variation in air pressure. For example, in the nozzle 7, a valve is activated at time t0, but the pressure of a rotating air flow actually supplied to the twist device T reaches a set normal value after time t4 has elapsed.

The above embodiment has been described in conjunction with a case wherein, when the back and third rollers 1 and 2, which have been stopped, are restarted to transfer the sliver 6 gripped by the back and third rollers 1 and 2, compressed air is substantially simultaneously re-jetted from the air blowing hole 13 to prevent the sliver 6 from being introduced into the sliver guide entrance 7*c* of the nozzle 7. Instead of the jetting of compressed air from the air blowing hole 13, the air jet from the air exit port 19*a* of the air blowing tube 19 can be temporarily increased to deflect, toward the suction tube 18, the thin tapered portion 6*a* supplied by re-driving the back and third rollers 1 and 2, thereby preventing the sliver 6 with the long tapered portion 6*a* from being introduced into the twist device T. After the long tapered portion 6*a* has been removed, the air jet from the air exit port 19*a* of the air blowing tube 19 is reduced to allow the sliver 6 to be introduced into the twist device T.

Although, in the above embodiment, the spindle supporting member 10 and the nozzle block 8 can come into contact with and can be detached from each other, the spindle supporting member 10 and nozzle block 8 constituting the twist device T may still be mutually integrated. In this case, the head A' of the transfer arm member A gripping the leading yarn Y' is located in proximity to the yarn exit port 9*c* of the spindle 9, and compressed air is supplied through the air blowing hole 13 in order to provide the insertion hole 9*b* of the spindle 9 with an air flow flowing toward the tip 9*a* while providing a suction air flow through the suction tube 18.

In addition, the drive rollers a1, a2 of the transfer arm member A are operated to pass the leading yarn Y' through the twist device T and then allow the leading yarn Y' to be ejected from the sliver guide entrance 7*c* in the twist device T. Thus, this embodiment can omit the air sucker member S.

The following describes the results of experiments for the present method and apparatus that supplies an air jet through the air blowing tube 19 during piecing and the conventional piecing method and apparatus, which does not supply such air jet.

When 32 piecing operations, in which an air jet was supplied through the air blowing tube 19 during piecing were performed using the present method and apparatus, a piecing portion was hard to identify and given the ranking "A" in 20 piecing operations, while a piecing portion could be identified but was not defective and was thus given the ranking "B" in 12 piecing operations. No piecing portion was identified as being defective or given the ranking of "C".

In conventional piecing operations without an air jet through the air blowing tube 19, a rank "A" piecing portion was formed in only one of 40 piecing operations, a rank "B" piecing portion was formed in 12 piecing operations, and a defective rank "C" piecing portion was formed in 27 piecing operations.

Thus, when an air jet was supplied through the air blowing tube 19, all 32 piecing operations were ranked "A" or "B", successful piecing operations, whereas in conventional piecing operations, ranked "A" or "B", successful piecing operations, were only 32.5% and 67.5% were ranked "C" or unsuccessful piecing operations.

The above configuration of the invention enables it to produce the following effects.

Since the tip of the sliver supplied from the front roller is removed before the sliver is introduced into the twist device while removing a portion of the fibers constituting it, the thin tapered portion of the sliver can be prevented from forming excessively long or frail piecing portions.

Since piecing is performed while the leading yarn drawn out from the sliver guide entrance of the nozzle remains drawn, the piecing portion is prevented from becoming excessively thick and has a stable form.

What is claimed is:

1. A piecing method for a spinning machine including a draft device having a plurality of draft rollers including a back roller and a front roller for feeding sliver to a twist device having a nozzle containing a sliver guide entrance spaced from said front roller of said draft device and air injection means for imparting a twist to sliver fibers introduced to said nozzle, a spindle having a tip at its end proximate to said nozzle for receiving spun sliver and an insertion hole at its distal end through which spun yarn is delivered to a delivery roller for winding into a bobbin, said method comprising:

providing a suction tube having a suction port and an air blowing tube opposed to said suction port in a space between said front roller and said nozzle of said twist device, upon breakage of said yarn, stopping said back rollers while maintaining rotation of said front roller to sever a tip of the sliver, simultaneously with the stopping of the back rollers activating said suction tube to remove said severed tip into said suction tube, stopping operation of said twist device, moving the leading yarn from said delivery roller to position said leading yarn in said spindle, providing a compressed air pipe in said spindle for injecting compressed air to eject said leading yarn through said spindle tip and said sliver guide entrance of said twist device to be received in said suction tube, returning said twist device to operation, rotating said delivery roller to take up said leading yarn from said suction tube through said twist device;

rotating the rollers of said draft device to supply sliver to said nozzle of said twist device for piecing with said leading yarn as it moves through said twist device, and simultaneously with the stopping of the back rollers continuing a supply of compressed air to said air blowing tube for directing compressed air on said sliver before it enters said nozzle of said twist device, whereby fibers are removed from said sliver to be sucked into said suction tube for removal and the amount of fibers pieced to said leading yarn is adjusted to produce a piecing portion more closely as thick as said leading yarn.

2. The piecing method for a spinning machine according to claim 1 including the step that the leading yarn is drawn out from said sliver guide entrance of the twist device and is retained by said suction tube.

3. A spinning machine comprising:

a draft device having a plurality of rotatable rollers operative to supply sliver to said machine, and means for selectively driving said rollers;

a twist device including a sliver guide entrance for receiving the sliver from said draft device and air injection holes for conducting air to impart a twist in the sliver supplied to said twist device to form yarn, and means for conducting a piecing operation including:

a suction tube fixedly disposed between said draft device and said twist device and having a suction port effective to receive a tip of said sliver removed from said sliver upon the termination of rotation of selected ones of said rollers of said draft device, a compressed air pipe fixedly disposed between said draft device and said twist device and having an air discharge port disposed adjacent said sliver guide entrance to said twist device, and means for controllably discharging compressed air from said air discharge port toward said suction port as said sliver is supplied by said draft device toward said sliver guide entrance for removing a portion of fibers constituting said sliver and delivering them to said suction tube to adjust the amount of fibers in the sliver delivered to said twist device during said piecing operation.

4. Apparatus for conducting a piecing operation in a spinning machine according to claim 3 wherein said air blowing tube faces said suction tube in such a way that said sliver guide entrance is located between the air blowing tube and said suction tube.

5. Apparatus for a spinning machine according to claim 3 including means for drawing a leading yarn out from the sliver guide entrance of the twist device and retaining it by said suction tube.

* * * * *